United States Patent [19]

Ito et al.

[11] 4,281,052

[45] Jul. 28, 1981

[54] IMAGE FORMING MEMBER

[75] Inventors: Hiroshi Ito, Narashino; Ichiro Endo, Yokohama; Shigeru Ohno, Tokyo, all of Japan

[73] Assignee: Canon Kabushiki Kaisha, Tokyo, Japan

[21] Appl. No.: 125,673

[22] Filed: Feb. 28, 1980

Related U.S. Application Data

[63] Continuation of Ser. No. 825,043, Aug. 16, 1977, abandoned.

[30] Foreign Application Priority Data

Aug. 18, 1976 [JP] Japan ..... 51/98437
Aug. 18, 1976 [JP] Japan ..... 51/98438

[51] Int. Cl.[3] ..... G03G 13/14

[52] U.S. Cl. ..... 430/48; 430/49; 430/60; 430/353; 430/618; 101/467

[58] Field of Search ..... 430/48, 49, 60, 353, 430/618, 620; 101/467, DIG. 13

[56] References Cited

U.S. PATENT DOCUMENTS

| | | | |
|---|---|---|---|
| 3,956,562 | 5/1976 | Shibata et al. | 430/60 |
| 4,009,049 | 2/1977 | Masuda et al. | 430/620 |
| 4,021,249 | 5/1977 | Noguchi et al. | 430/618 |
| 4,057,016 | 11/1977 | Endo et al. | 101/467 |
| 4,069,759 | 1/1978 | Endo et al. | 101/467 |
| 4,144,072 | 3/1979 | Ikenoue et al. | 430/618 |
| 4,397,493 | 6/1979 | Masuda et al. | 430/620 |

FOREIGN PATENT DOCUMENTS

| | | |
|---|---|---|
| 7654452 | 4/1975 | Belgium . |
| 1161777 | 8/1969 | United Kingdom . |
| 1264532 | 2/1972 | United Kingdom . |
| 1275929 | 5/1972 | United Kingdom . |
| 1364285 | 8/1974 | United Kingdom . |
| 1379876 | 1/1975 | United Kingdom . |
| 1413288 | 11/1975 | United Kingdom . |

OTHER PUBLICATIONS

Research Disclosure No. 9846, pp. 68–70, Jun. 1972.

*Primary Examiner*—J. Travis Brown
*Attorney, Agent, or Firm*—Fitzpatrick, Cella, Harper & Scinto

[57] ABSTRACT

An image-forming member for forming a metal grain image of the type containing a reducible metal compound which is able to isolate metal from it when reduced, and a reducing agent being capable of reducing the metal compound so that there may be formed a metal grain image by the metal isolated from the metal compound at the portion of the member subjected to the action of energy for producing a metal grain image-forming ability and thermal energy is characterized by the provision of a capturing means which is capable of capturing by-product produced from the metal compound upon the isolation of the metal from the metal compound.

11 Claims, 2 Drawing Figures

IMAGE FORMING MEMBER

This is a continuation of application Ser. No. 825,043, filed Aug. 16, 1977, abandoned.

BACKGROUND OF THE INVENTION

1. Field of the Invention

The present invention relates to an image-forming member and more particularly relates to an image-forming member of the type which contains in its binder a metal compound being able to isolate metal from it by the action of energy externally applied thereto.

2. Description of the Prior Art

Recently, in the technical fields of information recording, copy making and printing, there have been made rapid and remarkable development and improvement in process and material which make it possible to carry out recording, copying or printing at a higher speed and in a more simple and accurate manner.

Among them, a striking progress has been achieved in the copying or printing method by which a large number of copies or printings (hereinafter the term "duplicate" is used to include both the cases) are obtained from an original. In particular, there has been made a great effort to develope such type of system in which so-called master is produced from an original and a large number of duplicates are made using the master, and novel or improved materials used for producing such master as to satisfy various requirements such as simpler construction, easier operation, higher speed, more instantaneousness and lower cost.

As for materials for producing a master, various types of material have already been developed and known according as the type of printing method. For example, in the art of electrostatic printing there is known and used such type of master forming material which consists of a sheet like member having a photosensitive layer of zinc oxide resin dispersion system and on which sheet member an electrically insulating toner image is formed by the conventional electrophotographic technique. Also, there is known such master which is prepared by forming an insulating substance image on an electrically conductive base using etching or other suitable technique. All these masters have a common and important disadvantage. Since the image formed on the surface of the master is in the formed of relief pattern, its mechanical, electrostatic, repeating durability and resolving power are not so good and moreover the treatment involved in producing a master is very complicated.

As another type of master used in the electrostatic printing, there is a flat plate master having an even smooth surface. This master is made of an image-forming member containing therein a reducible metal compound. The image formed thereon is not in the form of relief pattern, but in the form of metal grain image pattern so that its surface is very smooth. Therefore, the possibility that the image may be damaged by mechanical friction during printing is very small and moreover it has the advantage of high mechanical, electrostatic, repeating durability.

Since the image pattern formed on the member is a metal grain image pattern composed of portions where isolated metal particles are distributed and portions where such metal are not distributed, an excellent electrostatic printability is attainable therefrom. Further, it has other various advantages such as high resolving power, continuity of gradation and the like.

The image-forming member from which such an excellent master can be made, contains a metal compound which isolates the metal under the action of energy externally applied to it. The member generally takes a form of sheet member comprising a base which may be, for example, a sheet of paper or plastic and a reducible metal compound-containing layer on the base. A master as mentioned above is produced by subjecting the image-forming member to an image forming treatment. One typical example of such image-forming member is a so-called heat-developable image-forming member which comprises a layer containing an organic silver salt dispersed into a suitable binder with sufficient film-shapability.

The heat-developable image-forming member has the advantage that all the processes required to form an image thereon can be carried out in the member of dry system and thereby the complexity and difficulty involved in producing a master can be eliminated or reduced to a great extent as compared with another type of image-forming members which necessitates wet treatment as image forming treatment.

The heat-developable image-forming member, especially when it is to be used for producing an electrostatic printing master, must be prepared by applying on a suitable base a layer containing a reducible metal compound such as organic silver salt dispersed into a binder that is an insulating medium having a sufficient electric resistance enough to retain the electrostatic charge.

From the image-forming member having such structure, an electrostatic printing master may be easily produced by imagewise exposing the member and then heat developing it. In this image forming treatment, there occurs the isolation of metal at the exposed portion of the member so as to form a metal grain image pattern.

As another image-forming member composed essentially of reducible metal compound like the case of the above-mentioned heat-developable image-forming member, there is known an imageforming member of the type which is subjected to the action of electrical energy to form a metal grain image therein. Namely, the image-forming member is initially subjected imagewisely to the action of electrical energy and thereafter subjected to a whole surface heating treatment. This results in forming a metal grain image pattern at the portion of the member subjected to both the actions of electrical energy and thermal energy. This type of image-forming member is also useful for producing an electrostatic printing master as described above.

By using the above described image forming members, forming of electrostatic printing master and electrostatic printing with the formed master are usually carried out in the following manner:

The master surface is charged with a charging device such as corona discharge device so as to form an electrostatic latent image. The latent image is then developed with suitable developer such as powder developer conventionally used in electrophotography. The developed powder image is transferred to a transfer sheet such as paper and fixed.

In these processes of electrostatic printing, sometimes occurs the case in which the charging treatment conducted on the master surface fails to produce a good electrostatic latent image having a sufficiently reduced background potential and an adequate electrostatic potential contrast enough for the practical use and thereby it becomes impossible to obtain a good transferred image.

This trouble is considered to be caused by the formation of by-product during the isolation of metal from the reducible metal compound in the image-forming member. Usually, in carrying out the above described electrostatic printing, the master is laid on a metal drum with the base side of the master being contacted with the drum surface as to form an electrical connection therebetween. Thus, an electrostatic image is formed by treating the master surface with electrostatic charge, for example, by means of corona discharging device. For this purpose, it is required that the portion of the master containing the metal isolated from the metal compound should have a sufficient charge dissipatability. But, the isolation of metal from the metal compound is inevitably accompanied with a formation of by-product at the portion in which isolated metal is produced. It is considered that this by-product may be relatively high in electric resistance and therefore may reduce the electric conductivity in the portion where the metal is isolated, or may increase the electric capacity in such portion, in any possible manner, for example, by electrically separating isolated metal grains from each other. For the reason, the by-product is considered to prevent the dissipation of charge when a charging treatment is carried out. This would in turn prevent the formation of high quality electrostatic image to be formed by the charging treatment.

Therefore, in order to enable to make always good quality master, it is necessary to prevent the dissipation of charge from being reduced by the by-product produced at the portion in which the metal compound isolated its metal.

The present invention aims at the solution of this difficult problem.

SUMMARY OF THE INVENTION

Accordingly, it is the primary object of the invention to provide an improved image-forming member which allows to produce at any time an electrostatic printing master from which an electrostatic latent image having a sufficiently low background potential and a sufficiently high electrostatic potential contrast enough to suit for practical use can be formed and thereby a good quality transferred image is obtainable.

Another object of the present invention is to provide an improved image-forming member which allows to produce an electrostatic printing master having an excellent charge dissipating property at the portion where metal is isolated from the metal compound.

Other and further objects, features and advantages of the invention will appear more fully from the following detailed description taken in connection with the accompanying drawings.

DESCRIPTION OF THE PREFERRED EMBODIMENTS

The arrangement of the image-forming member according to the invention is characterized by the provision of a capturing means. The function of the capturing means is to capture some by-product formed from the reducible metal compound contained in the member when the metal compound isolates its metal at the portion of the member subjected to the actions of energy for producing metal grain image-forming ability and thermal energy.

According to the invention, the capturing means may be provided as a layer in contact with an image-forming layer containing the reducible metal compound. Alternatively, the capturing means may be provided as means contained into the image-forming layer. Further, both manners for providing the capturing means as mentioned above may be effected contemporaneously.

The first embodiment shown in FIG. 1 comprises a base 1, which is generally a plastic film, resin sheet or paper, a capturing means-containing layer 2 (hereinafter referred to as "capturing layer") overlaid on the base, an image-forming layer 3 composed essentially of reducible metal compound and a surface layer 4 the provision of which is entirely optional. In this embodiment therefore, the capturing means is provided as a capturing layer 2 between the base 1 and the image-forming layer 3.

The capturing layer is composed in such manner that the layer has therein a plurality of micro-voids (micropores) which open at least into the side of the image-forming layer 3. A better result will be attained when the substance per se of which the capturing layer 2 is composed is porous. One example of such a capturing layer is a layer prepared by dispersing porous capturing substance having opening on its surface in the form of powder into a suitable binder and forming the dispersion into a layer.

Figure 1:
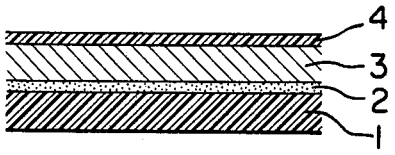
FIG. 1 schematically shows, in cross section, one representative structure of the image-forming member according to the invention.
Figure 2:
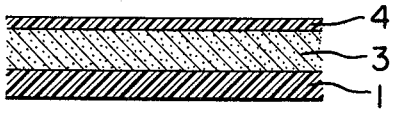
FIG. 2 shows another example of the image-forming member according to the invention.

In the second embodiment shown in FIG. 2, the capturing means does not take the form of a capturing layer 2 as in the case of the first embodiment shown in FIG. 1, but it is provided in such manner that capturing substance is dispersed into the image-forming layer 3. Also in this case, the capturing substance is preferably a porous substance having openings on its surface.

As described above, the capturing means which constitutes the essential feature of the present invention may be provided in the image-forming member in the form of a capturing layer 2 and/or in the form of dispersion. In the former case, the capturing layer is in contact with the image-forming layer 3. In the latter case, the capturing substance is dispersed into the image-forming layer 3 containing reducible metal compound so that the capturing means is contained in the image-forming layer.

The image-forming layer 3 may be formed by application of a dispersion of reducible metal compound in a binder that is an electrically insulating medium, using a suitable solvent.

The surface layer 4 may be formed from a dispersion of reducing agent on the image forming layer 3, for example by coating or dipping method. The dispersion is prepared by dispersing a reducing agent capable of reducing the metal compound described above in a suitable binder such as cellulose acetate by the aid of suitable solvent.

In order to form the capturing layer 2, capturing substance such as kaoline clay is mixed with and dispersed into a suitable binder having adequate film shapability by the aid of suitable solvent. Thereafter, the dispersion is applied onto the base 1 which is generally composed of paper or the like suitably treated. To form a layer 2 on the base 1, dipping or coating may be used.

It is also possible to form the capturing layer 2 not on the base 1 but on the image-forming layer previously formed in a similar manner to that described above. As an example, on a releasable support with good flatness there are initially applied a surface layer and an image-forming layer in this order or applied only an image-forming layer without any surface layer. Thereafter, a capturing layer is overlaid on the image-forming layer. When the surface layer, the imageforming layer and the capturing layer or the image-forming layer and the capturing layer are together able to self-support sufficiently by themselves, then these overlaid layers are released from the support after drying completely and film-forming so that the aimed image-forming member may be prepared. If these layers lack a sufficient self-supporting ability, then a base such as plastic film, resin sheet or paper sheet is applied onto the side of the capturing layer in a suitable manner such as bonding, press fixing or fused fixing and thereafter the formed image-forming member is released from the support.

The capturing means provided in the image-forming member in the above described manner has an evident effect on the improvement in charge dissipation at the portion where metal is isolated, and thereby contributes to the formation of good quality electrostatic latent image of sufficiently lowered background potential and high electrostatic potential contrast sufficient enough for practical purpose. However, the mechanism of such function of the capturing means has not yet been made clear. Possible assumptions of the mechanism are as follows:

Firstly, in case that capturing substance is contained in the image-forming layer comprising reducible metal compound, any possible by-product produced during forming a metal grain image may be captured by the capturing substance and fixed in it. As a result, the isolated metal particles may be disposed and orientated in such manner as to accommodate to the dissipation of charge.

Secondly, in case that a capturing layer is provided, the by-product may be captured or absorbed by the capturing layer and fixed in it. As a result, the isolated metal particles may be disposed and orientated in such manner as to accommodate the dissipation of charge.

Lastely, it is also assumed that when an image-forming layer containing reducible metal compound is provided on a capturing layer, the metal compound may be disposed and orientated in accordance with the surface condition of the capturing layer in such manner as to accommodate the dissipation of electric charge at the area where the metal is isolated. As a result, the by-product may also disposed and oriented under the effect of the capturing layer in such manner as not to prevent the electric charge from dissipating.

As previously mentioned, the capturing layer is obtained by dispersing capturing substance into a suitable binder and forming the dispersion into a film. But, when the capturing substance per se has a film shapability, the capturing layer may be formed without using any binder. Furthermore, within the scope of the invention, substances other than porous substance may be used as capturing substance for making the capturing layer provided that the substance is able to form micro-voids in the layer itself when a dispersion of the substance in a binder is formed into a film layer.

As capturing substance to be dispersed and contained in the image-forming layer and/or the capturing layer, various pigments are useful.

Preferable examples of capturing substance used in the invention are inorganic pigments as given below: zinc white (non-photoconductive $ZnO$), titanium dioxide (non-photoconductive $TiO_2$), lithopone ($ZnS+BaSO_4$), baryte ($BaSO_4$), gypsum ($CaSO_4.2H_2O$), lead sulphate ($PbSO_4$), barium carbonate ($BaCO_3$), whiting ($CaCO_3$), basic lead carbonate ($2PbCO_3.Pb(OH)_2$), magnesium carbonate ($3MgCO_3.Mg(OH)_2.3H_2O$), satin white ($Al(OH)_3+CaSO_4$), asbestos ($3MgO.2SiO_2.2H_2O$), kaoline clay ($Al_2O_3.2SiO_2.2H_2C$), glass fine particle, talc ($3MgO.4SiO_2.H_2O$), alumina white ($Al_2O_3.nH_2O$), gloss white ($Al(OH)_3+BaSO_4$), antimon oxide ($Sb_2O_3$) and carbon black.

These capturing substances may be used alone or in combination.

For the purpose of the invention, it is preferable to use these capturing substances in the form of powder The particle size and the sort of capturing substance to be used are suitably determined depending upon the sorts of the metal compound then used and the by-product then possibly produced as well as upon the capturing property of the used capturing substance. In general, when the above mentioned capturing substances are used in the form of powder, the particle size is less than $10\mu$, preferably less than $5\mu$ and most preferably less than $3\mu$. The upper limit of the particle size will be given by the limitation of the image-forming layer's thickness and the necessary capturing power since generally, the thickness of the image-forming layer is limited to a value under $50\mu$, and as to the capturing power, the smaller the particle size, namely the larger the surface area is, the larger capturing power can be obtained.

It is desirable that capturing substance be porous. The inorganic pigments mentioned above as preferable capturing substances are more or less porous and therefore they are effective for the present invention.

Besides the above mentioned inorganic pigments, porous ion-exchange resins may be effectively used in the invention as capturing substance. Examples of effective porous ion-exchange resin include chlorine type porous basic anion-exchange resin, polystyrene sulfonic acid type resin, I type resin and II type resin. Cellulosic material such as pulp also may be used as capturing substance.

When any of these capturing substances is contained in the image-forming layer, the content of the capturing substance may vary depending upon the required property of the master. But, the content is usually in the range of from 0.01 to 60 wt% and preferably from 0.05 to 50 wt% based on the weight of metal compound.

Since an image-forming layer is applied onto the capturing layer by coating or dipping, there is required to prevent any component material of the image-forming layer such as the reducible metal compound and insulating medium from permeating into the capturing layer during forming the image-forming layer. If the voids present in the capturing layer are too large, the component material of the image-forming layer may be permeated into the capturing layer when the image-forming layer is formed and thereby the voids in the capturing layer may be plugged. Therefore, the voids in the capturing layer must not be so large as to allow such permeation of the component material of the imageforming layer. However, it is rather desirable that the voids have a size large enough to selectively allow the permeation of the solvent used in forming the image-forming layer. This will accelerate the speed of the formation of image-forming layer.

The thickness of the capturing layer may vary depending upon the desired electrostatic printing property of master. But, it is generally in the range of from 1μ to 30μ and preferably from 2μ to 10μ. The lowest limit of the thickness is given mainly by the limitation of coating film forming technique and the necessary degree of capturing power. The use of a thickness over the upper limit will give arise various difficulties. For example, the formed image-forming member lacks flexibility. Moreover, when a master produced from the member is used to carry out electrostatic printing, the internal electric field applied to the capturing layer will become too large and thereby it will become impossible to obtain a sufficient high electrostatic contrast enough for the practical purpose.

In order to further improve the dissipatability of electric charge in the portion where metal is isolated and thereby to further improve the effect of the present invention, the capturing layer may be treated as to its electric conductivity. This electric conductivity treatment can be carried out by incorporating powder of aluminum, iron, carbon or the like into the capturing layer or by using electrically conductive organic polymer for binder to be used in forming the capturing layer. As such polymer, any of the three types, that is, cation type, anion type and nonion type may be used. The use of such polymer of low specific resistance is desirable for the present invention. Therefore, cation type quaternary ammonium salt high molecular polymers are preferable. Examples of quaternary ammonium salt electrically conductive high molecular polymer preferably used for this purpose are as follows:

polyvinyl trimethyl ammonium chloride, polyvinylbenzyl trimethyl ammonium chloride, poly(2-hydroxy-3-methacryloyloxy propyl trimethyl ammonium chloride), poly(n-acrylamid propyl-3-trimethyl ammonium chloride), poly(N-methylvinyl pyridinium chloride), poly(N-vinyl-2,3-dimethyl imidazolium chloride), poly(N,N-dimethyl-3,4-methylene piperidinium chloride), poly(diallyl ammonium chloride), quaternary polyethyl imine and β-dichloromethyl diphenyl ether condensation polymer.

Example of anion type conductive organic polymer is sulfone acid salt-containing polymer. Examples of nonion type polymer are polyoxyethylene alkyl ethers, polyoxyethylene alkyl phenol ethers and polyoxyethylene alkyl esters.

Also, capturing substances which per se have a electric conductivity may be used. Representative examples of such substance are carbon such as carbon black and graphite, cuprous iodide, zeolite and porous material containing polar compound. As for zeolite, for example, mention may be made of analite, sodalite, chobazite, natrolite, phillipsite, mordenite, beryl, cordierite, milarite, osumilite, hydrated nepheline, cancrinite and sonidine.

Examples of porous material include analite, sodalite, chobazite, natrolite, phillipsite, mordenite, beryl, cordierite, milarite, osumilite, hydrated nepheline, cancrinite and sonidine which contain therein polar compound such as alcohol, ammonia, dimethylformamide, salts of carboxylic acid, sulfuric acid derivatives, amines, quaternary ammonium salt, metal complex, inorganic salts, acrylate derivatives, vinyl ether derivatives and the like.

When the capturing means is to be provided by dispersing the conductive capturing substance into the image-forming layer, the adding amount and the kind or nature of the capturing substance should be appropriately determined so as to practically prevent any trouble from occurring in the master because, for example, if the conductive capturing substance is added in the image-forming layer above the appropriate amount, the dissipatability of charge in the non-metal grain image portion of the master is improved inadvantageously.

Examples of binder used in forming the capturing layer are as follows:

styrene butadiene·resin, alkyd resin, melamine resin, urea resin, melamine·alkyd resin, urea·alkyd resin, epoxy resin, polyester, unsaturated polyester, polyvinyl chloride, polyvinyl acetate, vinyl chloride·vinyl acetate copolymer, acrylic resin, acrylic copolymer, phenol resin, polyethylene, polystyrene, polyamide, butyral resin and resin of cellulose derivatives such as cellulose acetate and cellulose nitrate.

The amount of binder used in the capturing layer may be determined in accordance of the desired film shapability. Generally, the binder is used in the amount of 0.01–10 parts by weight and preferably 0.05–5 parts by weight per one part of the capturing substance.

The capturing means by which the present invention is characterized is considered to have such properties being capable of absorbing or capturing the above described by-product, disposing and orientating the reducible metal compound in such manner as to accommodate the dissipation of electric charge at the portion of image-forming layer where the isolated metal is produced, or preventing the by-product from reducing the dissipation of electric charge.

As already described above, the image-forming layer is composed essentially of reducible metal compound dispersed into a binder that is an electrically insulating medium.

The reducible metal compound is a main source supplying metal particle for forming metal grain images of the electrostatic printing master. The electrically insulating medium is selected from electrically insulating resinous binder materials, has film-shapability for forming the image-forming layer, and serves as a dispersion medium for dispersing the reducible metal compound, and if necessary other ingredients, uniformly in the image-forming layer. Furthermore, the electrically insulating medium imparts an electrostatic charge retentivity to the non-metal grain image portions of the electrostatic printing master so that electrostatic latent images having electrostatic potential contrast sufficiently high for practical purposes can be produced when the electrostatic printing master having metal grain images are charged.

The reducible metal compound effectively used in the present invention is selected from many organic metal salt compounds. Representative organic metal salt compounds used in the present invention are organic silver salts such as silver salts of organic acids, mercapto compounds and imino compounds and organic silver complex salts. Among them, silver salts of organic acids, in particular, silver salts of fatty acids are preferable.

Typical organic silver salts may be mentioned as shown below.

1. Silver salts of organic acids (1) Silver salts of fatty acids (1) Silver salts of saturated aliphatic carboxylic acids:
silver acetate, silver propionate, silver butyrate, silver valerate, silver caproate, silver enanthate, silver caprylate, silver pelargonate, silver caprate, silver undecylate, silver laurate, silver tridecylate, silver myristate, silver pentadecylate, silver palmitate, silver heptadecylate, silver stearate, silver nonadecylate, silver arachidate, silver behenate, silver lignocerate, silver cerotate, silver heptacosanate, silver montanate, silver melissinate, silver laccerate, and the like.

(2) Silver salts of unsaturated aliphatic carboxylic acids:
silver acrylate, silver crotonate, silver 3-hexenate, silver 2-octenate, silver oleate, silver 4-tetradecenate, silver stearolate, silver docosenate, silver behenolate, silver 9-undecynate, silver arachidonate, and the like.

(3) Silver salts of aliphatic dicarboxylic acids:
silver oxalate and the like.

(4) Silver salts of hydroxycarboxylic acids:
silver hydroxystearate and the like.

(2) Silver salts of aromatic carboxylic acids (1) Silver salts of aromatic carboxylic acids:
silver benzoate, silver o-aminobenzoate, silver p-nitrobenzoate, silver phenylbenzoate, silver acetoamidobenzoate, silver salicylate, silver picolinate, silver 4-n-octadecyloxydiphenyl-4-carboxylate and the like.

(2) Silver salts of aromatic dicarboxylic acids:
silver phthalate, silver quinoline and the like.

(3) Silver salts of thiocarboxylic acids silver,$\alpha,\alpha'$-dithiodipropionate, silver$\beta,\beta'$-dithiodipropionate, silver thiobenzoate and the like.

(4) Silver salts of sulfonic acids silver p-toluenesulfonate, silver dodecylbenzenesulfonate, silver taurinate and the like.

(5) Silver sulfinates silver p-acetoaminobenzenesulfinate and the like.

(6) Silver carbamates silver diethyldithiocarbamate and the like.

2. Silver salts of mercapto compounds silver 2-mercaptobenzoxazole, silver 2-mercaptobenzothiazole, silver 2-mercaptobenzimidazole, and the like.

3. Silver salts of imino compounds silver 1,2,4-triazole, silver benzimidazole, silver benztriazole, silver 5-nitrobenzimidazole, silver 5-nitrobenztriazole, silver o-sulfobenzimide, and the like.

4. Organic silver complex salts silver di-8-hydroxyquinoline, silver phtharazone, and the like.

Further representative examples of metal compounds used in the present invention other than the above-mentioned organic silver salts are lead behenate, copper stearate and nickel perchlorate.

Among the above-mentioned image-forming members, such image-forming member whose ability of forming metal grain images can be rendered by exposure to light needs an addition of halide when it was produced.

Halides used for this purpose may be inorganic halides or halogen-containing organic compounds. In particular, monovalent metal halides, alkaline earth metal halides and ammonium halides are preferable, because such compounds contribute to lower the background potential of the master.

Representative halides are as shown below.

(1) Inorganic halides:

Preferably inorganic halides are those having the formula $$MX_m$$

wherein X is a halogen such as Cl, Br and I, and M means hydrogen, ammonium or metal such as potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanium, iridium, aluminum and the like, and m is 1 when M is halogen or ammonium and a value of valency of a metal when M is the metal.

(2) Halogen-containing organic compounds:
carbon tetrachloride, chloroform, trichloroethylene, triphenyl methyl chloride, triphenyl methyl bromide, iodoform, bromoform, cetylethyl dimethyl ammonium bromide and the like.

The mechanism of function of the halides are not yet clear, but the mechanism is considered as follows.

The halides seem to react with the organic silver salts to produce silver halides which are photosensitive when the image-forming member is produced, and then silver is isolated from the silver halides by exposure to light. The isolated silver works as developing nucleus upon heat-development and accelerates the isolation of metal from the reducible metal compound as to form metal grain images.

Further, instead of the above-mentioned halides, silver halides, that is to say, silver chlorobromide, silver chlorobromiodide, silver bromoiodide and silver chloroiodide are also preferably used in the present invention.

The mechanism of function of the silver halides is considered that exposure causes isolation of silver from the silver halides and the resulting silver functions in the same manner as in the above-mentioned case of halide.

The above-mentioned halides and silver halides may be used alone or in combination.

It is desirable that the amount of the halide or the silver halide be as small as possible, provided that there is present a minimum amount of it enough to produce developing nucleus capable of conducting heat-development upon exposure.

When the halide or the silver halide is added in an amount over the necessary amount as mentioned above, silver halides which are photosensitive remain in the member and thereby photosensitivity of the member becomes unnecessarily so high that the member should be stored or handled with an extensive care not to expose the member to even a small quantity of light. Otherwise the member is subjected to color change and so-called fog is formed.

On the contrary, when the amount of the halide or the silver halide is less than that necessary, there can not be formed a sufficient amount of developing nucleus for heat-developing efficiently.

Taking such limitations into consideration, the amount of the halide or the silver halide is usually $1-10^{6}$ mole, preferably $10^{-1}-10^{-6}$ mole, more preferably $10^{-1}-10^{-5}$ mole per one mole of the reducible metal compound.

The halide or the silver halide may be incorporated into the image-forming layer. Further the halide or the silver halide may be incorporated into the surface layer. Still further, the halide or the silver halide may be incorporated into both the image-forming layer and the surface layer.

The reducing agent is added for the purpose of reducing the metal compound to isolate metal when heat-development is carried out.

The reducing agent may be directly dispersed in the image-forming layer, and alternatively, the reducing agent may be applied in a form of a layer, for example, by mixing the reducing agent with a film-shapable resinous binder such as cellulose acetate in an appropriate solvent and applying the resulting mixture to a surface of the image-forming layer to form a surface layer.

However, in case of producing the surface layer on an image-forming layer, it is desirable that a sufficiently thin surface layer be formed, or the film-shapable binder for the surface layer is made of a material which can not or hardly retain electrostatic charge because the surface of the surface layer is uniformly charged and thereby electrostatic latent images are hardly produced if the electrostatic charge retentivity of the binder is large.

The function of the reducing agent in the present invention is described above in detail.

Representative reducing agents are organic reducing agents such as phenols, bisphenols, naphthols, di- or polyhydroxybenzenes and the like.

Typical reducing agents are as shown below.

(1) Phenols:

aminophenol, 2,6di-t-butyl-p-cresol, p-methylaminophenol sulfate (metol), and the like.

(2) Bisphenols:

2,2'-methylene bis (6-t-butyl-4-methylphenol), 4,4'-butylidene bis (6-t-butyl-3-methylphenol), 4,4'-bis (6-t-butyl-3-methylphenol), 4,4'-thio bis (6-t-butyl-2-methylphenol), 2,2'-methylene bis (6-t-butyl-4-ethylphenol), and the like.

(3) Naphthols:

2,2'-dihydroxy-1,1'-binaphthyl, 6,6'-dibromo-2,2'-dihydroxy-1,1'-binaphthyl, bis(2-hydroxy-1-naphthyl) methane, methylhydroxynaphthalene, and the like.

(4) Di or polyhydroxybenzenes:

hydroquinone, methylhydroquinone, chlorohydroquinone, bromohydroquinone, pyrogallol, catechol and the like.

(5) Others:

1-phenyl-3-pyrazolidone (phenidone) and the like.

The reducing agents may be used in combination, if desired.

Among the above mentioned reducing agents, phenols and bisphenols are preferable, and bisphenols are more preferable.

The amount of the reducing agent is appropriately determined depending upon the desired characteristics of the image-forming member. Usually it is not more than 5 moles, preferably $1-10^{-5}$ mole per mole of the metal compound.

As the electrically insulating medium for forming the image-forming layer, there may be mentioned of resinous binders.

It is important that the resinous binder has a film-shapability and is not softened over a certain limit upon heat-development to avoid undue lowering of the binding property. In particular, the latter characteristic is very important because the softening of the binder results in deformation of the images when heat-development is effected with a heating roller.

Since the electrostatic printing methods which use an electrostatic printing master produced from the image-forming member are based on electrostatic potential contrast between non-metal grain image portions and metal grain image portions obtained by charging the surface of the master by corona discharging or the like, it is very important that electrostatic charge is retained as much as possible at the non-metal grain image portions while electrostatic charge is not retained as for as possible at the metal grain image portions. Therefore, the binder should have a specific resistance capable of retaining electrostatic charge.

In view of the above, there may be used a binder having a specific resistance as high as or higher than a specific resistance of a resin used for a photosensitive member having a photoconductive layer of a CdS-resin dispersion system or a ZnO-resin dispersion system as used usually in electrophotographic technique, though the binder used in the present invention is not limited to such binder. In other words, characteristics necessary for an electrostatic printing master is that there is electrostatic charge retentivity, to some extent, at non-metal grain image portions and in addition, the electrostatic potential contrast between the non-metal grain image portions and the metal grain image portions is high enough for practical use. For obtaining such electrostatic potential contrast, it is recommendable to select a binder capable of giving an electrostatic printing master in which a specific resistance at non-metal grain image portions of the master is higher than that at the metal grain image portions by two figures or more or preferably three figures or more.

The specific resistance of the binder is usually $10^{10}$ ohm·cm or more preferably $10^{11}$ ohm·cm or more, more preferably $10^{13}$ ohm·cm or more.

For the purpose of preventing formation of dielectric breakdown or pinholes at the non-metal grain image portions upon charging, it is necessary to select the dielectric breakdown strength of the binder depending upon degree of charging given by corona discharging and the like. The dielectric breakdown strength is usually 10 KV/mm or more, preferably 15 KV/mm or more.

In addition, it is preferable that the binder has a high moisture resistance. When the electrostatic printing master is used in a highly humid atmosphere, lack of moisture resistance results in lowering of the electric resistance at the non-metal grain image portions and thereby lowering of electrostatic potential contrast. Further, electrostatic charge flows to the surface direction of the master. Therefore, moisture resistance of the binder should be appropriately selected depending upon atmospheres and area where the master is used. The moisture resistance is preferably such that the equilibrium moisture content is not more than 3.0%, preferred with not more than 2.0% at a relative humidity of 20–100%.

Representative binders are as shown below:

polyvinyl butyral, polyvinyl acetate, cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinyl methyl ether, styrene-butadiene copolymer, polymethyl methacrylate and the like. These binders may be used alone or in combination.

The amount of the binder in the image-forming layer is usually 0.02–20 parts by weight, preferably 0.1–5 parts by weight per one part by weight of the metal compound. The above-mentioned polymers as binder have different chemical and physical properties depending upon the polymer condition so that it is necessary to select such polymers as suitable for the purpose of the present invention. For example, when the binder is polyvinyl butyral, a polyvinyl butyral having averaged degree of polymerization of 500–1000, degree of butyralation of at least 60 molar % and remaining acetyl group of not exceeding 3 molar %, is preferable.

As the solvents for dispersing the reducible metal compound in the electrically-insulating resinous binder, there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The image-forming layer may be produced by dispersing the reducible metal compound in the binder by using a solvent and coating the resulting dispersion on the support. The coating procedure may be carried out by known techniques for producing a thin film from a synthetic resin such as rotating coating methods, air-knife coating methods, wire-bar coating methods, flow-coating methods and the like. The thickness of the layer may be optionally controlled.

To the image-forming member according to the present invention, there may be added an aggregation accelerator for metallic silver upon heat-developing, a toning agent for control color tone of the resulting image, a stabilizer for images for a long time of storage, a light resistent agent capable of preventing a formation of fog during storing the material before use and preventing deterioration of formed images due to fog after forming the images, a dye sensitizer, a developing accelerator and the like, in an amount necessary for each agent in accordance with the characteristics of the image-forming member.

If desired, a plasticizer may be added to the image-forming member according to the present invention.

Representative plasticizers are dioctyl phthalate, tricresyl phosphate, diphenyl chloride, methyl naphthalene, p-terphenyl, diphenyl and the like.

As mentioned previously, the image-forming member according to the present invention has a base and an image-forming layer and if desired, other layer(s) on the base, and the thickness of the total layers on the base is usually 1–50 microns, preferred with 2–30 microns.

The base may be a metal plate such as aluminum, copper, zinc, silver and the like, a metal laminate paper, a paper treated to prevent permeation of a solvent, a paper treated with a conductive polymer, a synthetic resin film containing a surface active agent, a glass paper, synthetic resin, film and the like having on the surface a vapordeposited metal, metal oxide or metal halide. Further, there may be used an insulating glass, paper, synthetic resin and the like. In particular, a flexible metal sheet, paper or other conductive materials which can be wound on a drum are preferable.

The most general electrostatic printing process employing the electrostatic printing master produced from the image-forming member according to the present invention comprises charging, developing and transferring steps. For example, the electrostatic printing master is passed through, for example, under a negative corona electrode and negative charge is given to the surface region of the nonmetal grain image portions of the electrostatic printing master. In this case, a positive corona electrode or alternating current corona electrode may be used in place of the negative corona electrode. As the result, electrostatic images (electrostatic charge patterns) are formed selectively on the nonmetal grain image portions. The electrostatic images may be converted to toner images by known developing method such as cascade, magnet brush, liquid, magnedry, water developments and the like. When toner particles are not charged or charged with an electric charge opposite to that imparted to the electrostatic images, the toner particles attach to the electrostatically charged portions. Then, an image-receiving sheet is brought into contact with the surface of the toner images and the toner images can be transferred to the image-receiving sheet by, for example, applying a corona electrode of a polarity opposite to that of the toner particles from the back side of the image-receiving sheet. The toner images thus transferred may be fixed on the image-receiving sheet according to known methods. Usually, heat fixation, solvent fixation and the like are used and in case of liquid development, only drying may be necessary. Further a pressure fixation may be employed. Toner particles remaining on the surface of the electrostatic printing master after transferring may be removed by a cleaning means such as brush, furbrush, cloth, blade and the like to clean the surface of the master.

Electrostatic printing processes may be effected by a recycle of charging, developing, transferring and cleaning, or a recycle utilizing durability of the electrostatic images of developing, transferring, and cleaning. Cleaning step may be omitted, if desired.

The present invention will be understood more readily by reference to the following examples. However, these examples are intended to illustrate the invention and are not to be construed to limit the scope of the invention. Unless otherwise state, parts and % are expressed as those by weight.

EXAMPLE 1

Zinc white—10 parts
10% cellulose acetate solution in acetone—100 parts
were mixed together and thoroughly dispersed for 24 hours by a ball mill. The resultant dispersion was coated onto an aluminium foil 50μ thick by a wire bar and dried to form a capturing layer.

In this manner, several samples of capturing layers were prepared the thickness of which vary between 1μ and 30μ.

25 g of silver behenate, 120 g of methyl ethyl ketone and 120 g of toluene were milled together for 72 hours in a ball mill so as to form a homogeneous slurry.

Then, 50 g of 20% polyvinyl butyral solution in ethanol, 25 g of phthalazinone and 0.2 g of calcium bromide were added to the slurry to form a homogeneous dispersion.

The dispersion was coated onto the above described, treated substrate so as to form an image-forming layer having the thickness of 7μ as dried.

Further, a mixture of
2,2'-methylene bis-6-t-butyl-p-cresol—1.5 g
10% cellulose acetate solution in acetone—10 g and
acetone—30 g.
was prepared and coated onto the above image-forming layer.

Each sample of the image-forming members thus produced was tested in the following manner:

The sample was exposed to light of 100 W tungsten lamp at 6000 lux for five seconds and then developed at about 130° C. and at the rate of 3 m/min. with a roller type heating apparatus. In a similar manner, heat development was conducted also to an unexposed sample. Thus, there were obtained samples having metal grain image portion (exposed portion) and non-metal grain image portion (unexposed portion). Each of these samples was charged by corona discharging of +6 KV for 30 seconds and its surface potential was measured employing ELECTROSTATIC PAPER ANALIZER (manufactured by KAWAGUCHI ELECTRIC WORKS CO., LTD. Type SP-428). The results are given in the following Table 1. The table includes also the result obtained from a sample comprising no capturing layer as control.

TABLE 1

| Thickness of capturing layer (μ) | Surface potential (V) | |
|---|---|---|
| | unexposed portion | exposed portion |
| non (control) | 730 | 600 |
| 1 | 740 | 200 |
| 3 | 800 | 150 |
| 5 | 850 | 150 |
| 10 | 950 | 250 |
| 20 | 1100 | 300 |
| 30 | 1200 | 400 |

It was found that in all the samples having capturing layer of dispersed zinc white the potential at the exposed portion was reduced and that when toner developing was carried out using each the samples having capturing layer as an electrostatic printing master, a remarkable reduction of fogging was attained.

As to the samples provided with a capturing layer the thickness of which is above 10μ, an increase in potential was observed due to the increase in volume resistance. But, the use of thickness up to 30μ was found to be adoptable for practical purpose. The use of thickness over 30μ gave arise some problems. Therefore, it was found that film thickness up to 30μ is suitable for the capturing layer according to the invention.

EXAMPLE 2

10 parts of titanium dioxide (anatase type) and 100 parts of 10% electrically conductive organic polymer (Oligo-ZM-1010, manufactured by TOMOEGAWA Paper Manufacturing Co., Ltd.) solution were dispersed for 24 hours by a ball mill to form a homogeneous dispersion. The dispersion was coated in the thickness of 2μ onto a wood free paper sheet (image-receiving paper sheet for Canon NP-5000 (trade name) copier). Thereafter, the same dispersion for image-forming layer as used in Example 1 was coated onto the above treated paper sheet.

According to the procedure described in Example 1, the surface potential was measured and good result was obtained as shown in the following Table 2.

TABLE 2

| | Surface potential (V) | | Permeation of component material of image forming layer into the paper sheet |
|---|---|---|---|
| | unexposed portion | exposed portion | |
| untreated paper sheet | 620 | 610 | large |
| treated paper sheet | 580 | 180 | none |

EXAMPLE 3

25 g of magnesium carbonate, 25 g of kaoline clay and 200 g of electrically conductive organic polymer (Oligo-Z, manufactured by the above mentioned company) 20% aqueous solution were mixed together and after adding 100 g of water, the mixture was dispersed for three days by a ball mill. The resultant dispersion was coated in the thickness of 5μ onto a hydrophilized, biaxially stretched polyester film 75μ thick.

Onto the thus treated conductive film, there was applied an image-forming layer as described in Example 1. After image forming on the sample, it was used as an electrostatic printing master. Corona discharge of +7 KV was uniformly applied to the master and then developing was carried out with negatively charged toner according to the magnetic-brush developing method. Thus, a positive toner image was produced.

A transfer sheet of paper was overlaid on the toner image and a corona discharge as described above was applied to it from the side of transfer sheet so that a transferred image was obtained on the transfer sheet.

The above described printing process comprising the steps of charging, developing and transferring was repeated over 1000 times. There was not found any change on the surface of the master, which demonstrates the excellency of the electrostatic printing master.

EXAMPLE 4

100 g of kaoline clay, 20 g of 10% starch aqueous solution, 20 g of styrene-butadiene rubber latex (50%), calcium stearate and 200 g of water were mixed together and dispersed for three days by a ball mill. The resultant dispersion was coated onto a high quality paper sheet by wire bar coating in the amount of coating of 20 g/m$^2$. The coated paper still in half-dry state was dried with a photographic ferro-plate so as to make a clay coated paper with high brightness.

On the backside of the bright surface, there was coated by wire bar coating a 10% solution of electrically conductive organic polymer (PQ 50B, manufactured by Soken Chemicals Co., Ltd.) in methanol. In this manner, an electric conductivity-treated, coated paper was prepared.

After providing the coated paper with an image-forming layer on its coated surface side (bright surface side) in the same manner as in Example 1, exposing and developing were carried out in a conventional manner so that a sheet having a clear, negative print visible image was obtained.

To use the sheet as an electrostatic printing master, it was sticked on a rotary drum. Then, copies were made from the master by repeating a cyclic process comprising the steps of charging, toner developing, transferring and cleaning. Copying could be effected at high speed. Moreover, even after having made 1000 copies, there was not observed any deterioration on the surface of the master.

EXAMPLE 5

25 g of silver behenate, 5 g of zinc white and 120 g of methyl ethyl ketone were mixed together and milled by a ball mill for 72 hours to form a homogeneous slurry. Then, 50 g of 20% polyvinyl butyral solution in ethanol, 25 g of phthalazinone and 0.2 g of calcium bromide were added to the slurry.

The resultant mixture was coated in the thickness of 7μ (as dried film) onto an art paper 80μ thick as to form an image-forming layer.

Thereafter, a mixture of 1.5 g of 2,2'-methylene bis-6-t-butyl-p-cresol, 10 g of 10% cellulose acetate solution in acetone, and 30 g of acetone were coated further onto the image-forming layer so that an image-forming member was obtained.

Further, a thin coating of electrically conductive organic polymer (Oligo-Z, manufactured by the above mentioned company) was applied to the back side surface at the paper of the image forming member. Thus, a sample was prepared.

This sample was exposed to light through a positive for 20 seconds employing a tungsten light source (3000 lux) and heated for 2 seconds at about 130° C. by a roller type heating apparatus to effect developing. In this manner, a master having a negative, print visible image was obtained. Corona discharge of +7 KV was applied to the master uniformly and then developing was carried out with negatively charged toner by magnetic-brush developing method so as to form a positive toner image.

A transfer paper was overlaid on the toner image and corona discharge as mentioned above was applied to it from the side of transfer paper sheet. Thus, a transferred visible image was obtained on the transfer paper sheet.

The above printing process comprising the steps of charging, developing and transferring was repeated many times. Even after 1000 times repeating cycles, there was observed neither deterioration on the master surface nor deterioration of the quality of transferred image. Therefore, it was demonstrated that the master was a good repeating usable printing master.

Moreover, an excellent, faithful reproducibility was attained. The metal grain image exhibited a faithful reproducibility relative to the original and thereby the correspondingly good electrostatic image was formed. Accordingly, the toner image was produced as a faithful photographic image.

EXAMPLE 6

12.5 g of silver behenate and 12.5 g of silver stearate were dispersed together with 120 g of methyl ethyl ketone and 120 g of toluene for 72 hours by a ball mill.

Further, 10 g of kaoline clay and 100 g of 10% polyvinyl butyral solution in ethanol were disposed for 24 hours by a ball mill. The resultant dispersion was added to the above prepared silver behenate containing dispersion and then thoroughly stirred to form a homogeneous dispersion. Thereafter, 2.5 g of phthalazone and 0.20 g of calcium bromide were added to the dispersion and stirred to dissolve the additives.

The dispersion thus prepared was coated in the thickness of 10μ (as dried film) by a wire bar onto a hard aluminium foil 50μ thick so as to form an image-forming layer.

A mixture of 1.5 g of 2,2'-methylene bis-6-t-butyl-p-cresol, 0.3 g of phthalazinone, 10 g of 10% cellulose acetate solution in acetone and 30 g of acetone was coated further onto the image-forming layer containing silver behenate stearate.

The sample thus prepared was exposed to light for 20 seconds through a positive using a tungsten light source (3000 lux) and then heated at about 130° C. for five seconds by a roller type heating apparatus to effect developing. In this manner, a master having a negative, print visible image was obtained.

Corona discharge of −7 KV was applied to the master uniformly and then developing was carried out with positively charged toner by magnet-brush developing method. A positive, toner image was obtained. A transfer paper sheet was overlaid on the positive toner image and corona discharge as described above was applied to ti from the side of transfer paper sheet. Thus, a visible, transferred image was obtained on the transfer paper sheet.

EXAMPLE 7

25 parts of silver behenate, 120 parts of toluene and 120 parts of methyl ethyl ketone were dispersed for 72 hours by a ball mill to form a homogeneous slurry.

Further, several kinds of dispersion were prepared by dispersing 10 parts of a capturing substance powder shown in the following Table 3 into 100 parts of 10% polyvinyl butyral methanol solution by a ball mill for 72 hours respectively. Each the dispersions thus prepared was mixed with the above slurry in the mixing ratio of 1 part (dispersion) to 2 parts (slurry). Thereafter, 0.3 wt% of mercury acetate, 0.6% of phthalazone and 0.05% of calcium bromide were added to the mixture and dissolved in it. In this manner, several different kinds of coating solution for making image-forming layer were obtained.

Each the coating solution was coated in the thickness of 10μ onto a hard aluminium foil 50μ thick to form an image-forming layer.

On the image forming layer, there was applied a coating of 2μ thick with a homogeneous solution comprising 1.5 parts of 2,2'-methylene bis-6-t-butyl-p-cresol, 0.3 parts of phthalazinone, 10 parts of cellulose acetate (10% acetone solution) and 30 parts of acetone. In this manner, the samples 1–6 were prepared. The samples 7–9 were prepared in the same manner for the samples 1–6 except that noncapturing substance, i.e., non-porous substance is used in place of capturing substance.

For each the samples, exposing was carried out for five seconds using a 100 W tungsten lamp (6000 lux) and then developing was carried out by bringing the exposed sample into contact with a heating plate of about 125° C. The unexposed portion was also heat-developed simultaneously. The same image forming process was carried out also for the sample 10 (control) containing no capturing substance in its image forming layer.

Each the samples was then charged by corona discharging with +6 KV and the surface potential was measured with an electrostatic potentiometer, i.e. electrostatic paper analyzer (SP-428, manufactured by KAWAGUCHI ELECTRIC WORKS CO., LTD.). The results are given in the following Table 3.

The results showed that pigments are especially effective as capturing substance.

TABLE 3

| Sample No. | Capturing substance, or non-capturing substance | Surface potential (V) unexposed portion | Surface potential (V) exposed portion |
|---|---|---|---|
| 1 | titanium oxide (anatase type) | 630 | 140 |
| 2 | lithpone | 610 | 150 |
| 3 | gypsum | 600 | 170 |
| 4 | magnesium carbonate | 650 | 180 |
| 5 | talc | 600 | 150 |
| 6 | glass fine particle | 650 | 260 |
| 7* | polyethylene powder | 680 | 500 |
| 8* | epoxy resin powder | 700 | 500 |
| 9* | phenol resin powder | 680 | 490 |
| 10* | — | 700 | 580 |

Note:
*Samples 7, 8, 9 and 10 are controls.

EXAMPLE 8

According to the procedure described in Example 7, various samples having each a negative, print visible image were prepared from the corresponding image-forming members. The samples were used as a electrostatic printing master respectively. From the system in which pigment powder was used as capturing substance (Sample Nos. 1–5), there was obtained good transferred image with less fogging and also shown high mechanical, electrostatic repeating durability. Therefore, these samples were found to be particularly effective as electrostatic printing master.

EXAMPLE 9

100 g of a 10% cellulose acetate solution in acetone and 20 g of titanium dioxide (rutile type) were mixed together and dispersed by a ball mill for 72 hours to prepare a homogeneous dispersion. The dispersion was then coated onto a hard aluminum foil having a thickness of 70μ, the surface of which was matted by use of a sand paper, by means of a wire bar to form a layer having a thickness of 5μ.

Next, 25 g of silver behenate, 3 g of magnesium carbonate, 120 g of methyl ethyl ketone and 120 g of toluene were together mixed and dispersed by a ball mill for 72 hours to prepare a homogeneous slurry. 50 g of a 20% polyvinyl butyral resin solution in ethyl alcohol was added to the slurry and then the milling was effected for several minutes to prepare a dispersion. At a dark place, to the dispersion, 20 ml of a 0.6% mercury acetate solution in methanol, and 20 ml of a 1% calcium bromide aqueous solution were succesively added at intervals of 30 min. with stirring. Further, 2.5 g of phthalazinone was added to the mixture and the stirring was effected for 30 min.

The dispersion thus obtained was coated onto the abovementioned layer formed on the aluminum foil and dried at 80° C. for 5 min. to form an image-forming layer having a thickness of 7μ as dried which is in the form of white mat and in which silver behenate is dispersed.

A mixed solution consisting of:

2,2'-methylene bis-6-t-butyl-p-cresol 1.5 g
10% cellulose acetate solution in acetone 10 g
Acetone 30 g
Phthalazinone 0.3 g was prepared and coated onto the image-forming layer to form a layer having a thickness of 3μ as dried.

The image-forming member thus obtained was divided into three equal sheets A, B and C. The sheet-A was exposed to light of 100 W tungsten lamp at 6000 lux for 5 sec. and then developed at about 130° C. and at the rate of 2 m/min. with a roller type heating apparatus to obtain the sheet colored in black.

The sheet-B was directly subjected to the heat development under the same condition without applying the exposure treatment. As a result, the sheet unchanged in color and remained in white.

Both black sheet and white sheet thus obtained were charged at +6 KV and their surface potentials were measured employing ELECTROSTATIC PAPER ANALIZER (manufactured by KAWAGUCHI ELECTRIC WORKS CO. LTD. Type SP-428). It was found that the surface potential in the black sheet was 150 V while that in the white sheet was 800 V.

On the other hand, the sheet-C was exposed to a light of a tungsten light source (3000 lux) through a positive image for 20 seconds, and thereafter heat development was effected at 130° C. and at the rate of 2 m/min. to obtain a visible negative print image. The corona discharging of +7 KV was uniformly applied to the whole surface of the sheet and the development was effected by the magnetic brush method using a negatively charged (−) toner so that a positive toner image was obtained.

A transfer paper was overlaid on the toner image and then corona discharge with positive polarity was applied to it from the side of the transfer paper. Thus, a toner image was obtained on the transfer paper, and such image was fixed by heating to obtain a permanent transferred image.

The image reproduction process was repeated many times. Even after 1000 times or more repeating cycles, there was observed neither any change in the sheet surface nor deterioration of the quality of the image on the transfer paper. Therefore, it was confirmed that the master was a good repeating usable printing master.

EXAMPLE 10

100 g of a 10% cellulose acetate solution in acetone and 20 g of barium sulfate were mixed together and dispersed by a ball mill for 72 hours to prepare a homogeneous dispersion. The dispersion was then coated onto a hard aluminum foil having a thickness of 70μ, the surface of which was matted by use of a sand paper, by means of a wire bar to form a layer having a thickness of 5μ.

Next, 25 g of silver behenate, 3 g of barium sulfate, 120 g of methyl ethyl ketone and 120 g of toluene were together mixed and dispersed by a ball mill for 72 hours to prepare a homogeneous slurry. 50 g of a 20% polyvinyl butyral resin solution in ethyl alcohol was added to the slurry and then the milling was effected for several minutes to prepare a dispersion, 20 ml of a 0.6% mercury acetate solution in methanol, and 20 ml of a 1% calcium bromide aqueous solution were successively added at intervals of 30 min. with stirring. Further, 2.5 g of phthalazinone was added to the mixture and the stirring was effected for 30 min.

The dispersion thus obtained was coated onto the above-mentioned layer formed on the aluminum foil and dried at 80° C. for 5 min. to form an image-forming layer having a thickness of 7μ as dried which is in the form of white mat and in which silver behenate is dispersed.

A mixed solution consisting of:

2,2'-methylene bis-6-t-butyl-p-cresol—1.5 g

10% cellulose acetate solution in acetone—10 g
Acetone—30 g
Phthalazinone—0.3 g
was prepared and coated onto the image-forming layer to form a layer having a thickness of 3μ as dried.

The image-forming member thus obtained was divided into three equal sheets D, E and F. The sheet-D was exposed to light of 100 W tungsten lamp at 6000 lux for 5 sec. and then developed at about 130° C. and at the rate of 2 m/min. with a roller type heating apparatus to obtain the sheet colored in black.

The sheet-E was directly subjected to the heat development under the same condition without applying the exposure treatment. As a result, the sheet unchanged in color and remained in white.

Both black sheet and white sheet thus obtained were charged at +6 KV and their surface potentials were measured employing ELECTROSTATIC PAPER ANALIZER (manufactured by KAWAGUCHI ELECTRIC WORKS CO., LTD. Type SP-428). It was found that the surface potential in the black sheet was 120 V while that in the white sheet was 780 V.

On the other hand, the sheet-F was exposed to a light of a tungsten light source (3000 lux) through a positive image for 20 seconds, and thereafter heat development was effected at 130° C. and at the rate of 2 m/min. to obtain a visible negative print image. The corona discharging of +7 KV was uniformly applied to the whole surface of the sheet and the development was effected by the magnetic brush method using a negatively charged (−) toner so that a positive toner image was obtained.

A transfer paper was overlaid on the toner image and then corona discharge with positive polarity was applied to it from the side of the transfer paper. Thus, a toner image was obtained on the transfer paper, and such image was fixed by heating to obtain a permanent transferred image.

The image reproduction process was repeated many times. Even after 1000 times or more repeating cycles, there was observed neither any change in the sheet surface nor deterioration of the quality of the image on the transfer paper. Therefore, it was confirmed that the master was a good repeating usable printing master.

In addition, the same procedure as above was repeated except that talc was used in place of barium sulfate. Also at that time, excellent result was obtained.

What we claim is:

1. In an electrostatic printing process comprising the steps of:

(a) providing an electrostatic printing master from a heat developed photosensitive member having a layer formed by uniformly dispersing a reducible organic silver salt compound in an insulating medium, said layer upon imagewise exposure from an original and heating, providing both a conductive metallic silver grain image corresponding to said image and undesirable by-products tending to prevent conduction through the metallic grain image during electrostatic printing, (b) forming an electrostatic latent image, (c) developing said image, and (d) transferring said developed image to a transfer material, the improvement comprising: employing a capturing means associated with said member capable of capturing said by-products, said capturing means consisting essentially of (i) a capturing layer being overcoated with said organic silver salt layer, or (ii) a capturing substance dispersed in said organic silver salt layer said capturing layer (i) being composed of a capturing substance having a particle size of not more than 10 microns, said capturing substance selected from a particulate inorganic pigment, a porous ion-exchange resin, a cellulosic material, a zeolite or polar adducts thereof, electrically conductive salts, and mixtures thereof, whereby high quality electrostatic images are formed.

2. The process of claim 1 wherein the capturing layer is porous.

3. The process of claim 2 wherein the capturing substance in said capturing layer is a porous powder substance.

4. The process of claim 2 wherein the capturing substance is relatively electrically conductive.

5. The process of claim 2 wherein the capturing layer contains electrically conductive substance(s).

6. The process of claim 2 wherein the capturing layer comprises, as a binder, electrically conductive organic polymer(s).

7. The process of claim 2 wherein the capturing layer has a thickness from 1μ to 30μ.

8. The process of claim 7 wherein the capturing layer has a thickness from 2μ to 10μ.

9. The process of claim 1 wherein the capturing substance dispersed in said silver salt layer is a porous powder substance.

10. The process of claim 9 wherein the content of said capturing substance is from 0.01 weight percent to 60 weight percent based on said silver salt compound.

11. The process of claim 9 wherein the content of said capturing substance is from 0.05 weight percent to 50 weight percent.

* * * * *